US006014019A

United States Patent [19]

Parker

[11] Patent Number: 6,014,019

[45] **Date of Patent: *Jan. 11, 2000**

[54] CONVERTER FOR A DC POWER SUPPLY HAVING AN INPUT RESISTANCE IN SERIES WITH A DC REGULATING CIRCUIT

[75] Inventor: Keith Philip Parker, Amesbury, United Kingdom

[73] Assignee: Autotronics Engineering International Ltd, Turtola, Virgin Islands (Br.)

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,958

[22] PCT Filed: Jan. 9, 1996

[86] PCT No.: PCT/GB96/00033

§ 371 Date: Aug. 8, 1997

§ 102(e) Date: Aug. 8, 1997

[87] PCT Pub. No.: WO96/21892

PCT Pub. Date: Jul. 18, 1996

[30] Foreign Application Priority Data

Jan. 13, 1995 [GB] United Kingdom ..... 9500661

[51] Int. Cl.[7] ..... G05F 1/59

[52] U.S. Cl. ..... 323/273; 323/269

[58] Field of Search ..... 323/269, 273, 323/276, 279; 361/709; 363/141

[56] References Cited

U.S. PATENT DOCUMENTS

| | | | |
|---|---|---|---|
| 2,925,548 | 2/1960 | Scherer | 323/276 |
| 3,453,519 | 7/1969 | Hunter | 323/273 |
| 3,705,342 | 12/1972 | Dalke | 323/273 |
| 4,151,456 | 4/1979 | Black | 323/273 |
| 4,316,135 | 2/1982 | Rall | 323/276 |
| 4,672,302 | 6/1987 | DeShazo et al. | 323/277 |
| 4,800,331 | 1/1989 | Vesce et al. | 323/277 |
| 4,827,205 | 5/1989 | Hafner et al. | 323/281 |
| 4,914,542 | 4/1990 | Wagoner | 323/277 |
| 5,041,777 | 8/1991 | Riedger | 323/277 |
| 5,225,766 | 7/1993 | O'Neill | 323/273 |
| 5,289,109 | 2/1994 | Summe | 323/277 |
| 5,397,978 | 3/1995 | Parry et al. | 323/277 |

OTHER PUBLICATIONS

"Spannungsregler Im Automobil"; Elecktronik, vol. 32, No. 2, Jan. 28, 1983, pp. 82–84.

"Spannungsregler Mit Minimaler Verlustleistung"; Elecktronik, vol. 40, No. 12, Dec. 1991, pp. 96 & 98–102.

*Primary Examiner*—Jeffrey Sterrett
*Attorney, Agent, or Firm*—Larson & Taylor

[57] ABSTRACT

A converter is provided for stepping-down a DC power input to produce a DC power output of lower voltage. The converter includes a regulating unit (3), and in series with it an input resistor (4). In use, the resistor (4) is separated from the regulating unit (3) and is mounted on a body of a piece of machinery, so that heat produced within the resistor is transmitted to that machinery, and does not interfere with the operation of the regulating unit (3). The regulating unit (3) employs a linear conversion circuit which produces a stable (DC) output but, unlike conventional DC-DC converters, generates substantially no stray electromagnetic fields.

20 Claims, 9 Drawing Sheets

CONVERTER FOR A DC POWER SUPPLY HAVING AN INPUT RESISTANCE IN SERIES WITH A DC REGULATING CIRCUIT

BACKGROUND OF THE INVENTION

1. Field of the Invention

The present invention relates to an item of electrical apparatus, and in particular to apparatus for converting the supply voltage of a DC power supply.

2. Summary of the Prior Art

Recent years have seen the emergence and development of a wide range of electronic accessories for motor vehicles, motor boats and other large pieces of equipment. Among such electrical accessories are lights, heating units, and more recently of course increasingly sophisticated telecommunications devices. Rather than carry their own source of electrical power, many accessories are intended to draw energy from the battery power source of the larger pieces of equipment, and are therefore designed to be compatible with the 12 volt batteries which are now standard in motor cars. The optimum input voltage of many electronic accessories is in fact 13.8 volts.

Unfortunately, the DC supply format used in other industrial, military, commercial, aviation, maritime and other applications differs considerably. Large vehicles, for example, require electrical power to be carried over comparatively longer lengths of cable with, in addition, an increased number of devices using the DC supply.

Therefore, if the DC supply is doubled in voltage from the nominal 12 volts to a nominal 24 volts the current demand is halved although the overall power available would be unchanged.

For example, large commercial or heavy vehicles typically use the higher DC voltage format centered around a nominal 24 volts.

There is therefore a requirement for converters capable of receiving the output of these higher DC voltage formats and supplying current in an acceptable form to 12 volt format electric accessories, that is to say a converter capable for example, of providing a constant supply of 13.8 volts from a varying supply of between 23.3 volts and 27.6 volts.

It should be appreciated that such a converter may have to deliver a power supply of several watts, tens of watts or even hundreds of watts, and that in this context problems are encountered which have no counterpart in microelectronic power conversion systems. For example, U.S. Pat. No. 4,827,205 discloses an on-chip 10 volt voltage supply in which current is delivered through a 10k resistor, which limits the power delivery to be of the order of milli-watts. In such a context conversion efficiency is unimportant and heat generation causes no significant problems.

An early generation of DC power converters, often misnamed "Droppers", were based upon linear converters, which is to say devices which step-down and regulate a voltage supply principally using transistor technology. It was perceived, however, that such devices perform their tasks with unacceptably low power conversion efficiency. Furthermore, no design of linear converter was found which could provide an output voltage with sufficient stability, particularly when the current demand at the output increased to any significant degree.

Many devices used as accessories in vehicles, boats, the aviation industry or other equipment, require a reasonably smooth and stable DC supply voltage.

Recent developments in DC power converters have therefore concentrated on methods of DC power conversion in which a DC supply powers an oscillator circuit, often housed under the dashboard of the lorry, for generating an oscillating voltage across the terminals of a step-down transformer. The output of the transformer is then rectified, smoothed and regulated to provide the desired supply, usually nominally 12 volts. Surprisingly, progressive refinements of this method have resulted in devices of up to 75% efficiency, and such systems are very widely employed.

The present inventor has found, however, that oscillation based power converters suffer from at least two serious disadvantages.

A first disadvantage of many switched-mode (oscillation) based converters is that their circuitry is all too likely to be damaged by the heat generated within them when the converter is abused, for example by direct electrical connection of its output terminals. In practice over the life of the converters operatives tend to replace any safety fuses (or fuses supplied with the converter) with incorrect fuses or, worse, by-pass them entirely.

This leads to significant fire hazards.

Secondly, they generate by their nature powerful electromagnetic radiation, often referred to as radio frequency interference, which is often radiated in a manner that affects electrical, electronic and more often communications equipment within the local area of the converter.

This is a widespread occurrence and, although many devices are claimed to have adequate filtering within their design, this problem occurs continually.

This problem is potentially more serious when the radiation affects users of devices and/or communications equipment completely remote and both unattached and unconnected to the converter mounted on the vehicle or equipment in question.

In many instances the user of the conversion device has no knowledge that it may be causing interference externally to other services.

SUMMARY OF THE INVENTION

The present invention, which is intended, inter alia for use in private, commercial and military vehicles, private, military and commercial maritime craft or smaller boats, the aviation industry, industry generally and for other pieces of equipment, seeks to overcome the problems of electromagnetic radiation and/or of overload conditions whatever external protection may exist with respect to relevant fuse ratings.

In its most general terms, the present invention proposes a converter having a first portion which controls DC voltage conversion and a second position, spaced from the first, in which heat may safely be developed.

Accordingly, in a first aspect the invention provides a converter for a DC power supply having an input resistance means in series with a DC regulating circuit of which an output is to be at a voltage lower than an input voltage into the converter, the resistance means being locatable distant from said regulating circuit.

In a second aspect, the invention provides a converter for a DC power supply comprising an input resistance means connected in series with a DC regulating circuit of which an output is to be at a voltage lower than the input voltage to the converter, the resistance means and regulating circuit being located in different respective housings.

In a third aspect, the invention provides a converter for a DC power supply comprising an input resistance means connected in series with a DC regulating circuit of which an output is to be at a voltage lower than an input voltage into the converter, the resistance means and regulating circuit being adapted for mounting in different respective locations on a piece of machinery.

A converter according to any aspect of the present invention is preferably capable of delivering electrical power of at least one watt, and more preferably electrical power up to several tens or hundreds of watts.

The resistor of the input resistance means will usually have a value not greater than 10 ohms, preferably 0.1 to 5 ohms and most preferably 0.5 to 1.5 ohms.

It is intended that in use the converter is connected to the battery power supply of a large piece of equipment, for example a lorry, and that the resistance means is mounted on the body of the equipment, e.g. the chassis of the lorry, so that heat may be dissipated to the body distant from the regulating circuit.

Although the regulating circuit may use oscillation it preferably employs linear converters, so that substantially no electrical noise is created on the output power supply. In this case both the disadvantages of linear converters described above may be overcome, or at least substantially reduced, since the regulating circuit can be selected so that in use a major portion, for example at least 60% and preferably at least 70% of the heat generated by the voltage converter is produced in the resistance means, and be spaced distant from the regulating circuit. This arrangement significantly lessens the necessity for the circuit to perform power conversion at high efficiency, since there is less heat generation in the location of the regulating circuit itself, and hence the regulating circuit can be selected to optimise output stability and regulation regardless of the output current drawn. Overall power conversion efficiency is not of paramount importance in this application, since both the supply current capability and the battery capacity are very large in the application specified.

The regulating circuit is preferably further selected to limit the current which can be drawn from the converter, for example by limiting output current to be below an upper critical limit, or simply by ceasing to supply output voltage when the converter detects an irregularity in the current drawn from the converter, a technique known as fold back. This is preferably achieved independently of the presence or absence of interrupters such as fuses or circuit breakers, which can be tampered with.

The resistance means is preferably adapted for mounting on the body of a large piece of machinery in such a way that there is good heat conduction therebetween, whereby heat generated within the resistance means is rapidly conducted away. The regulating circuit is preferably mounted on a heatsink formed with a high surface area to enhance its capacity to transmit heat generated by the regulating circuit to ambient air, e.g. by convection.

The heatsink for use with the regulating circuit preferably has high surface area and longitudinal symmetry. It may be mounted with its longitudinal axis vertical so that when it becomes warm a vertical flow of air is created along it, thereby improving the ability of the heatsink to transmit to the atmosphere the heat generated by the regulating circuit.

The regulating circuit is preferably selected to cease transmitting power when the temperature of the circuit rises above a predetermined value. This "thermal cutout" is a useful safety feature, even in combination with the fold back feature described above, since the conditions which trigger fold back do not necessarily occur instantaneously upon occurrence of a fault. Furthermore, it is possible to have overheating without electrical overload, for example if the regulating circuit is located in a region too warm for the heat sink to operate satisfactorily.

BRIEF DESCRIPTION OF THE DRAWINGS

Further objects and advantages of the present invention will be explained in the following detailed description of preferred exemplary embodiments with reference to the accompanying figures in which.

DETAILED DESCRIPTION

Figure 1:
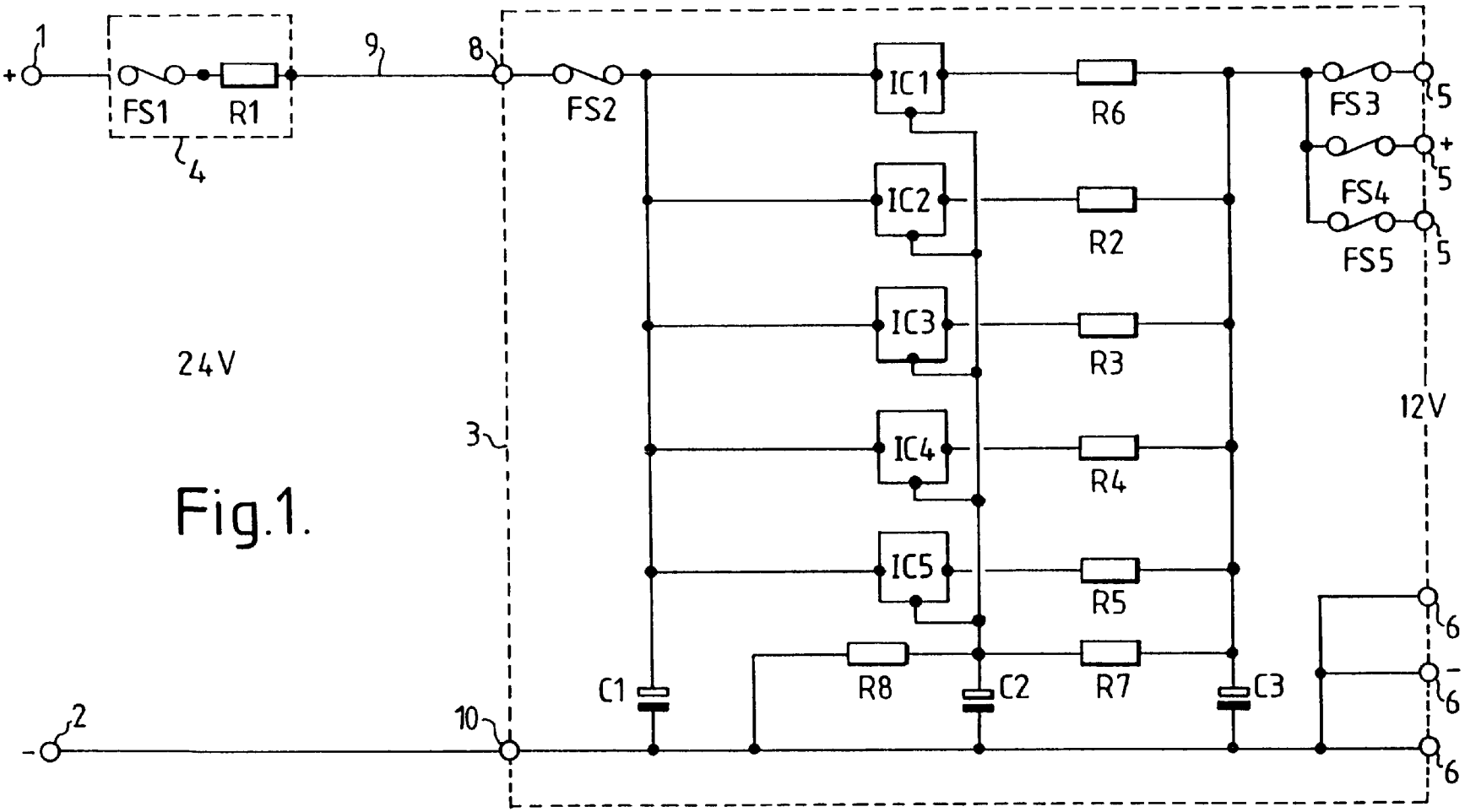
FIG. 1 shows the circuit diagram of a first embodiment of a DC converter according to the invention.

Referring firstly to FIG. 1, the first embodiment of the DC converter of the present invention has input terminals 1,2 for connection respectively to the terminals of an external battery of a piece of equipment, such as the 24 V battery of a lorry. The regulating circuit is positioned within a regulating unit 3 which has input terminals 8,10 for receiving electrical power and output terminals 5,6 for connection to the power inputs of electronic accessories. The converter steps down the DC voltage from the battery so that the voltage difference between its input terminals 1,2 is greater than e.g. twice the voltage difference between the output terminals 5,6. In series with the regulating unit 3 between the battery terminals 1,2 is resistance unit 4 comprising a resistor R1 and a fuse FS1.

The resistance unit 4 is connected to the regulating unit 3 by a cable 9, the length of which is at least several centimetres and preferably up to several metres, so that the resistance unit 4 can be located distant from the regulating unit. The resistance unit 4 is adapted to be mounted on a massive part of the equipment such as the chassis of the lorry, so that the heat it generates is transmitted into the chassis. The regulating unit 3 is located elsewhere on the lorry, either at a different location on the chassis or, for example, under the lorry dashboard, and makes good thermal contact with a heatsink adapted to transmit the heat generated by the regulating unit 3 to the surrounding air.

Within the regulating unit 3, current is divided equally between the resistors R2, R3, R4, R5 and R6, all of equal resistance, of the same order as (but not necessarily the same as) the resistance of R1. The voltage between output terminals 5 and 6 is maintained at 12 volts using 5 regulators IC1 to IC5 which each have a 3 amp specification, and are controlled in operation by resistors R7 and R8 and capacitors C1, C2 and C3. In this way using standard components it is possible to maintain an output current of up to 15 amps, which is considerably higher than the current output of conventional converters.

The regulators IC1 and IC5 are preferably selected so that the regulating unit 3 ceases to supply power when the regulators reach a predetermined temperature. For example, the regulators may be integrated circuits KA350, which has that property.

In one selection of component values which gives correct 24 voltage to 12 volt conversion, R1 takes the value of 0.5 ohms, while resistors R2 to R6 each have a resistance of 0.015 ohms; C1 is a 1,000 μF/35 volt electrolytic capacitor; and C2 is a 100 μF/16 volt electrolytic capacitor. IC1 to IC5 may be 8 volt/3 amp regulators and in this case resistors R7 and R8 have values of 220 ohms and 150 ohms respectively. Alternatively, IC1 to IC5 may be 5 volts/3 amp regulators and in this case R7 and R8 have values of 500 and 860 ohms respectively. In alternative embodiments, the regulators IC1 to IC5 are 12 volt regulators, and the voltage of the output of the circuit can be made to be 13.8 volts by selecting R7 and R8 to be 480 and 72 ohms respectively. C3 is a 2200 μF/16 volt electrolytic capacitor.

In this embodiment FS1 and FS2 are blade fuses having respectively 25 amp and 15 amp capacities. FS3, FS 4 and FS 5 are a further three blade fuses, the total value of which does not exceed 15 amps; usually each has a capacity of 5 amps.

Figure 2:
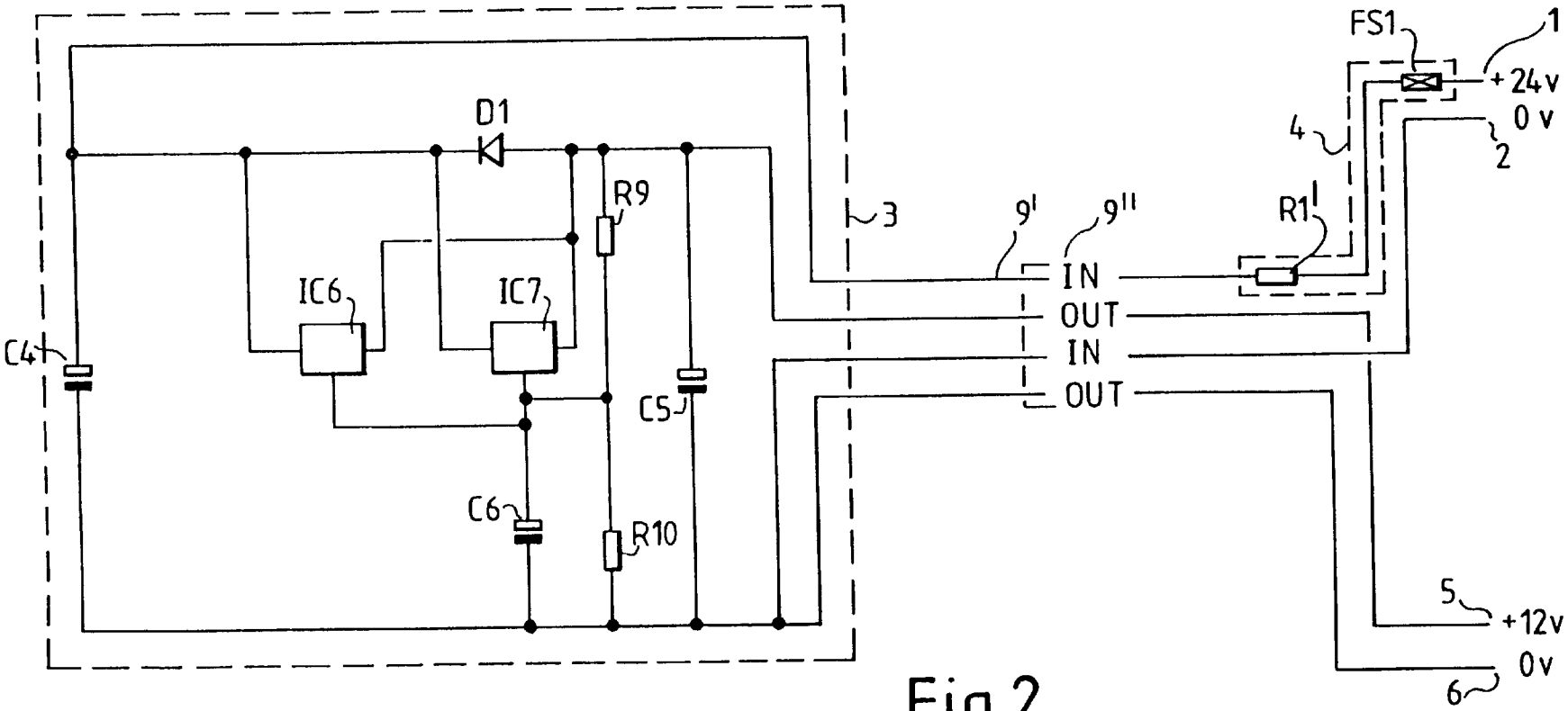
FIG. 2 shows the circuit diagram of a second embodiment of the DC converter.

FIG. 2 illustrates a second embodiment of the invention being a modified version of the first embodiment. This second embodiment is preferred to the first embodiment, since it is cheaper and simpler to manufacture. It is designed to output 5 amps, and will automatically cease supplying power in conditions of electrical overload or overheating. The converter will then automatically recommence normal functioning when the fault condition has been removed or the temperature reduced to a permissible level.

In this embodiment the resistance unit 4 on the input side is separated from the regulator unit 3 by a multi-cable lead 9' including connector jack and plug assembly 9".

Figure 3:
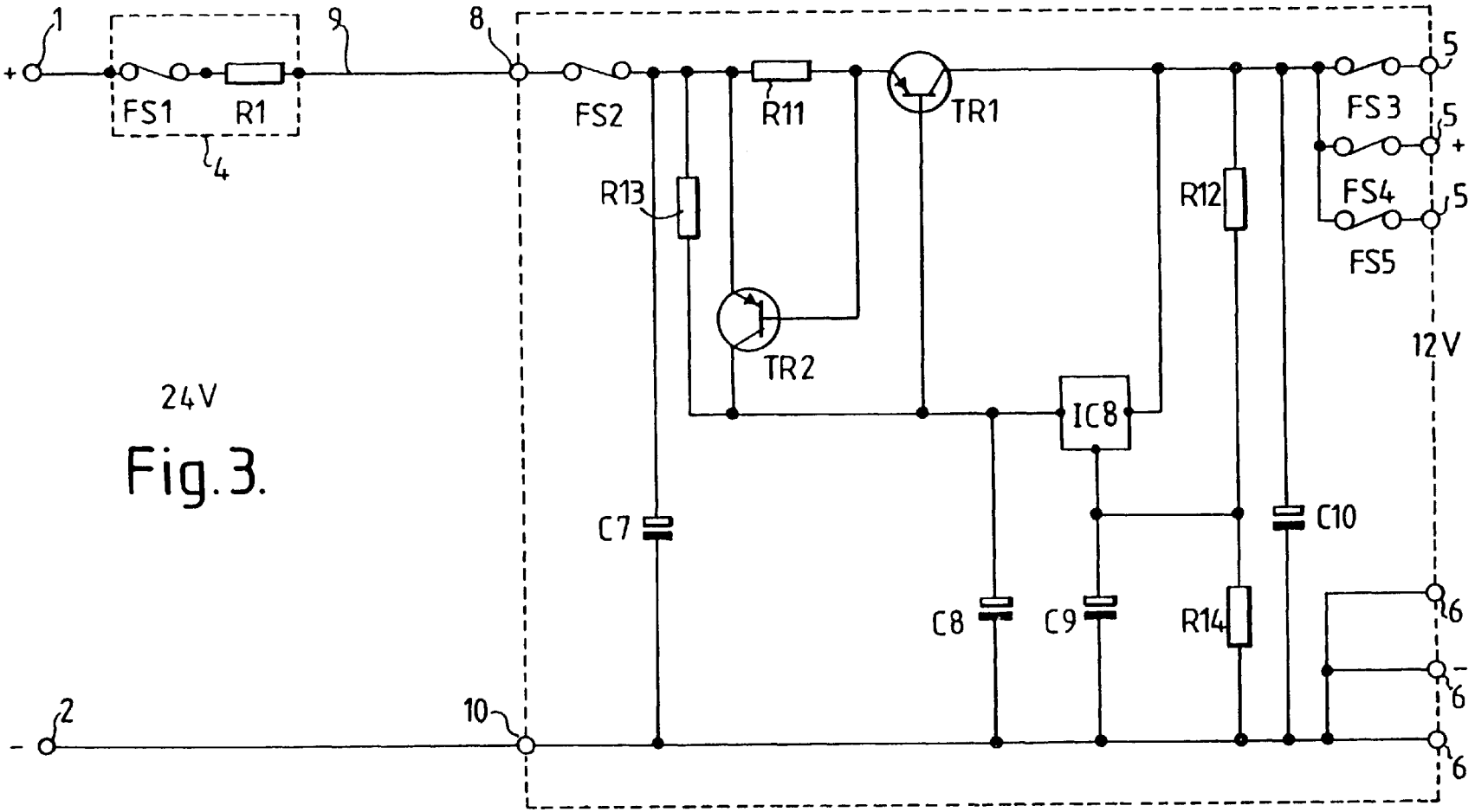
FIG. 3 shows a circuit diagram of a third embodiment of the DC converter.

Values for the components in this circuit are:

IC6, IC7=Integrated circuit regulator type LM350
C4=Electrolytic capacitor 47 μF/35 V
C5, C6=Electrolytic capacitor 100 μF/16 V
D1=Diode IN4001
R1'=Wirewound resistor 1.5 ohms
R9=Wirewound resistor 120 ohms
R10=Wirewound resistor 1.2K ohms A third embodiment shown in FIG. 3, employs a resistance unit 4 equivalent to that in the first embodiment, but uses a different regulating circuit in which current flows principally through resistor R2. The specification of the components in the circuit is as follows:

TR1=PNP Transistor (TO3) MJ15004.
TR2=PNP Transistor (TO220) BD744.
IC8=Integrated Circuit Regulator type L7808CP.
C4=Electrolytic Capacitor 2200 μF/16 volts.
R1=Wirewound Resistor, 0.5 ohm/100 watt.
R11=Wirewound Resistor, 0.05 ohm/25 watt.
R12=Metal Film Resistor 220 ohm/1 watt.
R13=Wirewound Resistor 3.3 ohm/2.5 watt.
R14=Metal Film Resistor 150 ohm/1 watt.
C7=Electrolytic Capacitor 1000 μF/35 volts.
C8=Electrolytic Capacitor 1 μF/35 volts.
C9=Electrolytic Capacitor 1000 μF/35 volts.
C10=Electrolytic Capacitor 2000 μF/16 volts.

As will be appreciated by a skilled person, the above choice of IC8 means that the circuit ceases to deliver a voltage when its temperature reaches a predetermined value. Thus, there is a thermal cutout at this temperature.

Figure 4:
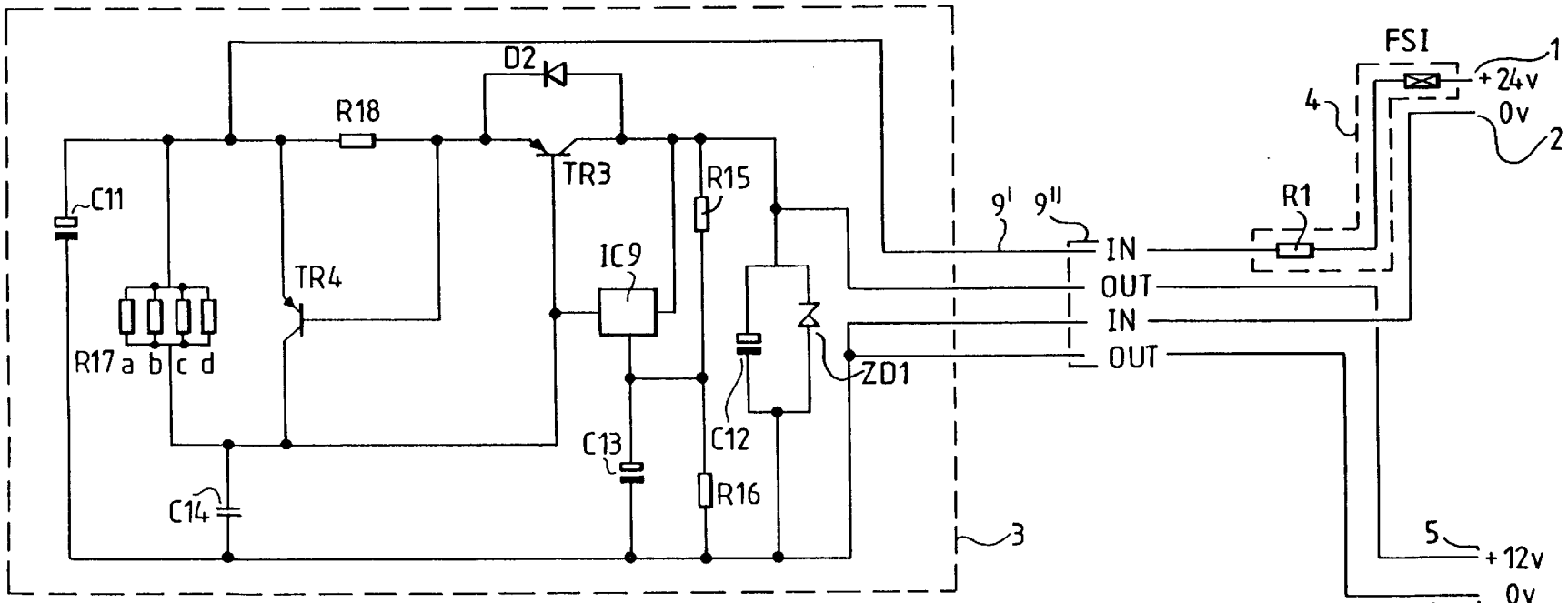
FIG. 4 shows a circuit diagram of a fourth embodiment of the DC converter.

FIG. 4 illustrates a fourth embodiment of the invention, being a modification of the third embodiment. The fourth embodiment is preferred to the third embodiment since it is cheaper and easier to manufacture. It is designed to output up to 15 amps.

As in the second embodiment, the regulator unit 3 is connected, via resistance unit 4, to the input and output via a lead 9' and jack and plug assembly 9".

Values of the components shown are:

D2=Diode type IN4001
IC9=Integrated circuit type LM 350
TR3=Transmitter type MJE 15004
TR4=Transistor type BD 744C
ZD1=Zener diode type IN5355B
C11=Electrolytic capacitor 47 μF/35 V
C12, C13=Electrolytic capacitor 100 μF/16 V
C14=Electrolytic capacitor 0.47 μF/63 V
R1=Wirewound Resistor 0.5 ohms
R15=Wirewound Resistor 120 ohms
R16=Wirewound Resistor 1.2K ohms
R17a-d=Each 27 ohms
R18=Wirewound Resistor 0.05 ohms In the embodiment illustrated in FIG. 5, current is again principally conducted to output terminals 5,6 through resistor R19. The voltage is regulated using integrated circuit IC9, which is a regulator of type L123CT. This converter has the feature that when the circuit experiences a severe current fluctuation, which may arise for example if the output terminals of the circuit are connected together, IC9 causes the output voltage to take a low level until it is reset, a technique of current limitation known as "fold back".

Values of components in the circuit are as follows:

TR4=NPN Transistor (TO3) 2N3771.
TR5=NPN Transistor (TO220) BD743C.
IC10=Integrated Circuit Regulator type L123CT.
C15=Electrolytic Capacitor 1000 μF/35 volts.
C16=Electrolytic Capacitor 10 μF/16 volts.
C17=Electrolytic Capacitor 2200 μF/16 volts.
C18=Electrolytic Capacitor 4.7 μF/35 volts.
C19=Ceramic Capacitor 470 μF/100 volts.
R1=Wirewound Resistor 0.5 ohm/100 watt.
R19=Wirewound Resistor, 0.05 ohm/25 watt.
R20=Metal Film Resistor 6.8 Kilohm/0.25 watt.
R21=Metal Film Resistor 3.6 Kilohm/0.25 watt.
R22=Metal Film Resistor 7.5 Kilohm/0.25 watt.

Other components have the same values as the corresponding components of the third embodiment of the voltage converter.

Figure 5:
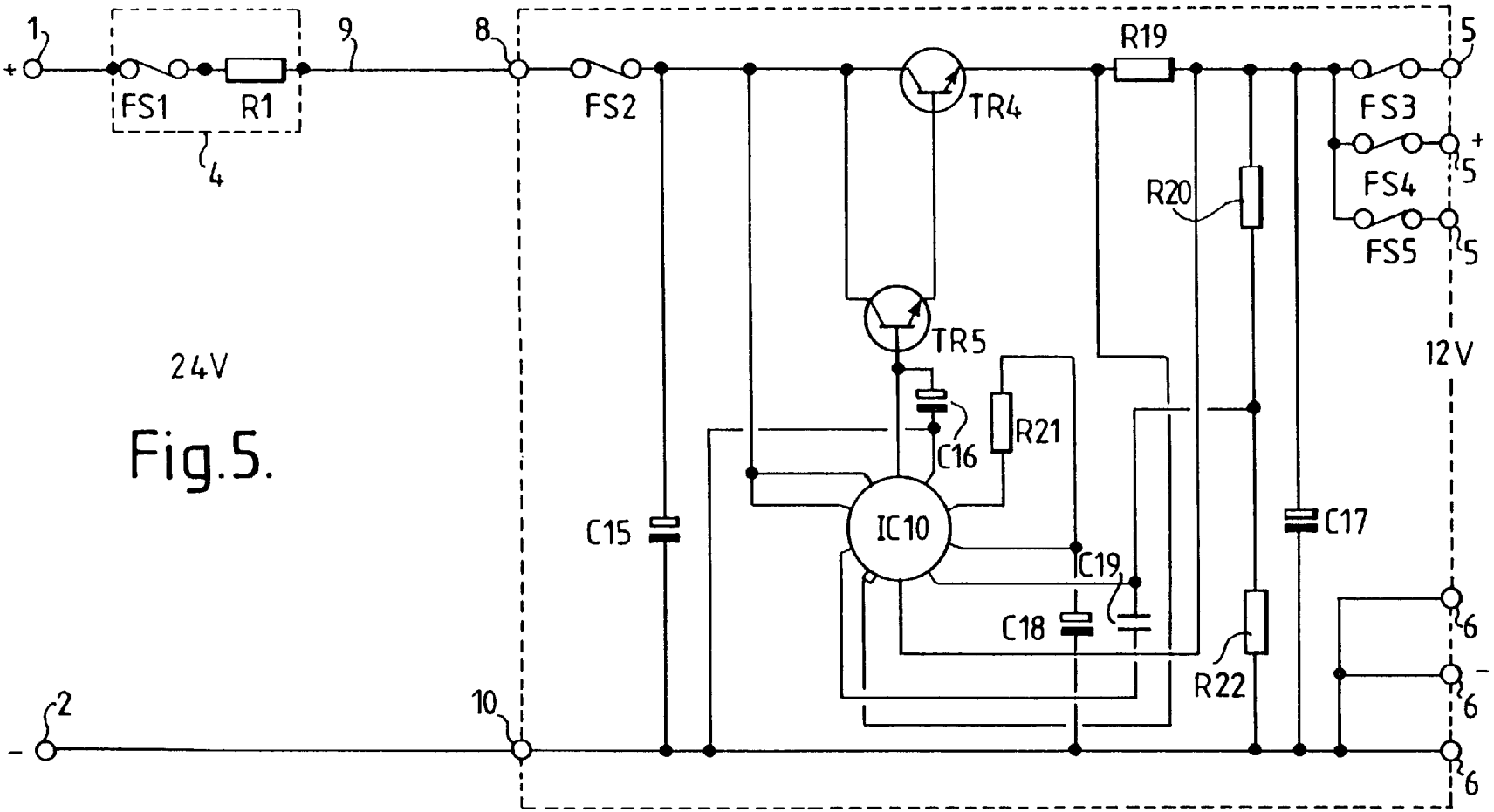
FIG. 5 shows a circuit diagram of a fifth embodiment of the DC converter.
Figure 6:
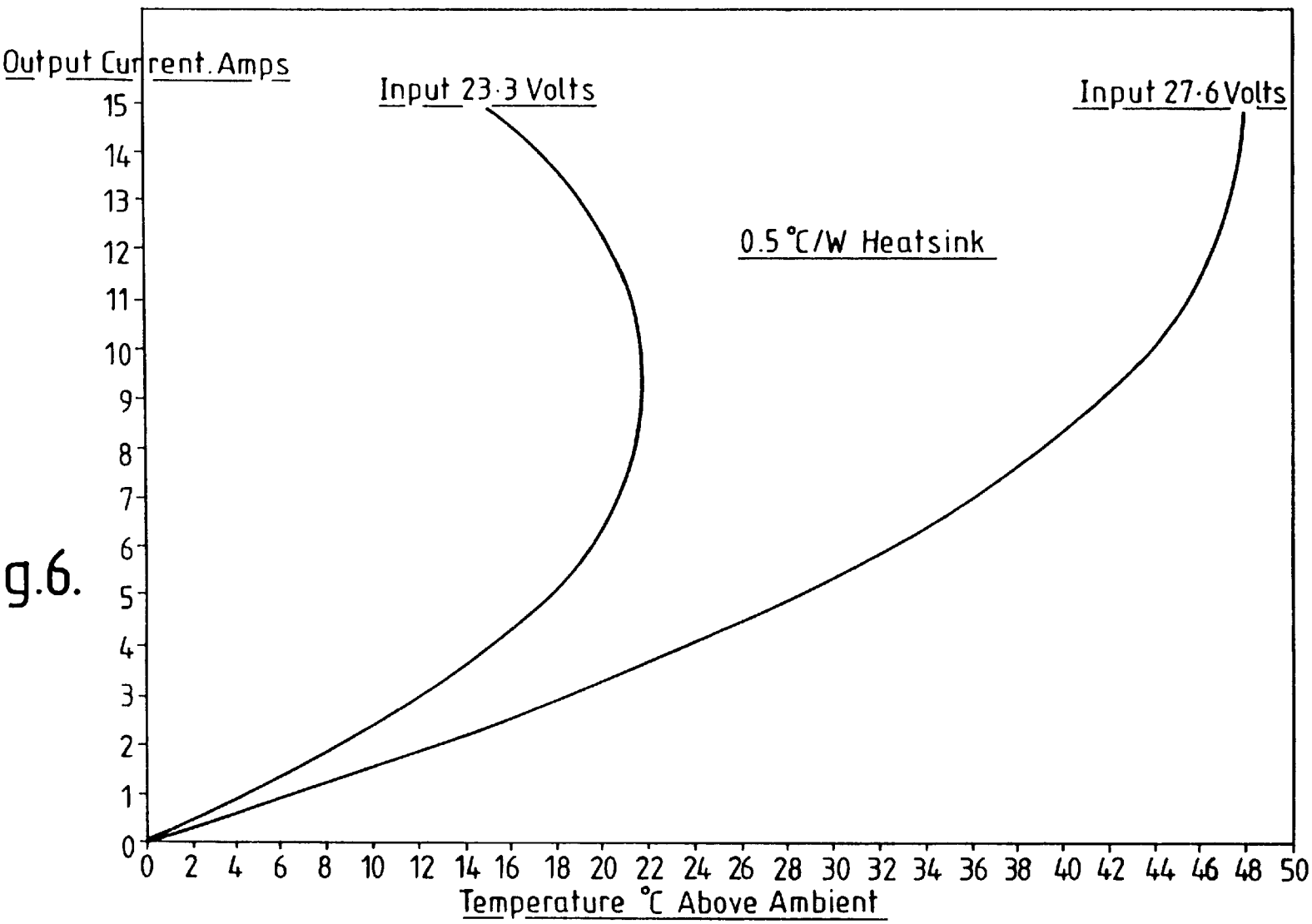
FIG. 6 illustrates the relationship between the temperature of the heatsink of the third and fifth embodiments of the DC converter with the output current supplied.

FIG. 6 illustrates the relationship between the temperature of the heatsink and the current drawn from the output of the voltage converter of FIG. 3 or FIG. 5. The two curves represent respectively the cases that the input to the voltage converter is 23.3 volts (the lowest voltage typically delivered by a lorry's battery) and 27.6 volts (which may be delivered while the battery is charging). Ideally, the converter is operated in a range of currents between the two curves.

It has been found that the first, third and fifth embodiments of the invention given above fulfill the following specification.

Output Voltage:—13.8 Volts DC.
Output Current:—0 to 15 Amps.
Input Voltage:—23.3 Volts to 27.6 Volts DC.
Maximum Input Voltage Overvolt:—35 Volts DC Short Term Fault Condition Vehicle Supply
Current Overload:—Type 2 Current Limit at 15 amps. (Also Type 1).
Protection:—Type 3 Current Foldback at 15 amps.
Operating Temperature Range:—Better than −40° C. to +40° C. *

*At +40° C. Heatsink Temperature is 86° C./15 amps.

The second and fourth embodiments deliver up to five and fifteen amps respectively, or a maximum wattage of 60 or 180 Watts respectively.

Figure 7:
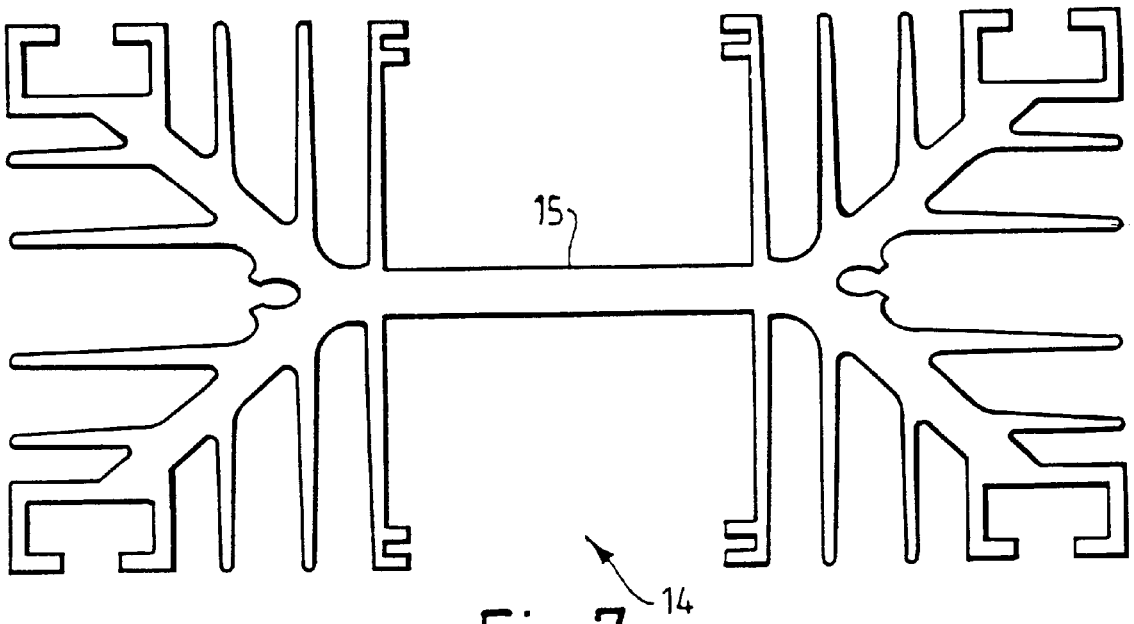
FIG. 7 is an end view of a heat sink suitable for use in the present invention.

FIG. 7 is an end view of a heatsink 14 suitable for use as the heatsink for the regulator unit. The heatsink 14 is suitably an aluminium extrusion. It has longitudinal symmetry, and is to be mounted with its longitudinal axis vertical for maximum dissipation of heat by convention.

Figure 8:
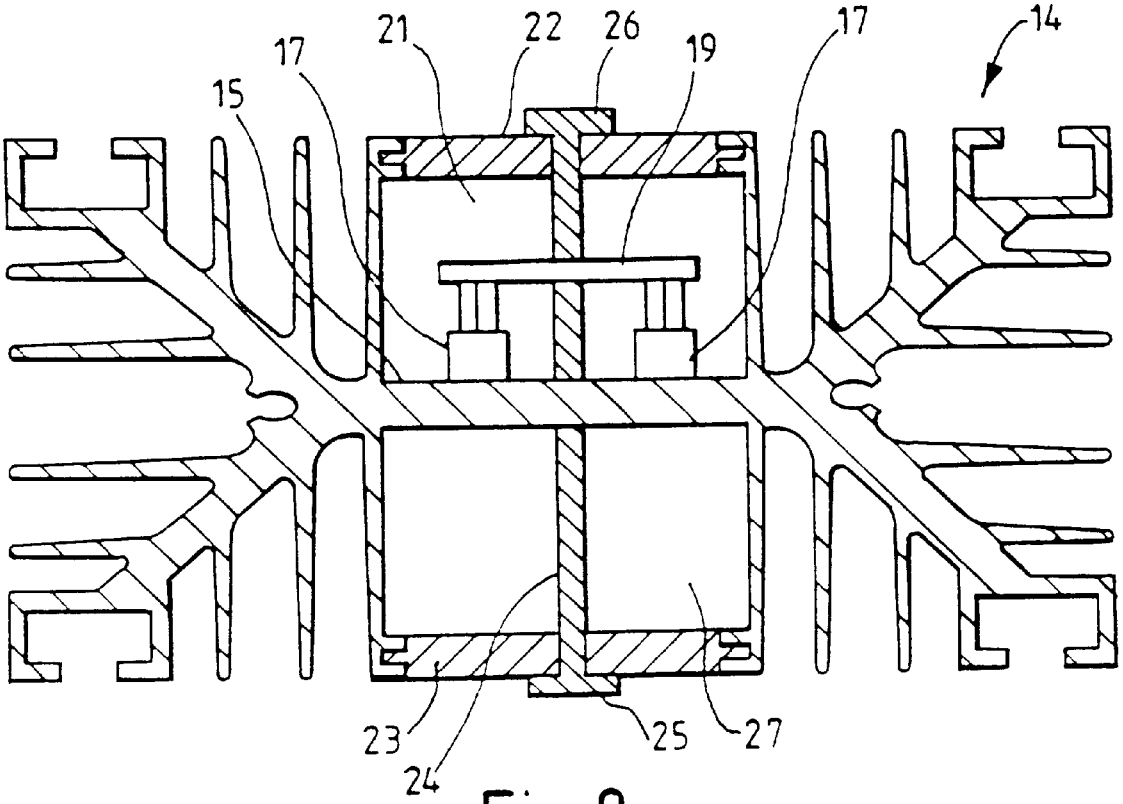
FIG. 8 is a cross-sectional view of a regulating circuit according to the present invention incorporated into the heat sink shown in FIG. 7.

FIG. 8 illustrates how the regulator circuit may be built into the heat sink 14 shown in FIG. 7 to provide a heat sink unit. Components 17 of the regulating circuit, connected by a printed circuit board 19, are placed in contact with a central surface 15 of the heat sink 14, so that good thermal conduction is obtained between the components 17 and the surface 15. The circuit is then potted in a thermally conductive potting compound 21 which provides mechanical support for the circuit board 19. The regulating circuit does not extend along the whole length of the heatsink 14, but leaves end portions of the surface 15 uncovered. Thus, when the potting compound is applied, along the whole length of the heatsink 14, the regulating circuit is entirely surrounded by the potting compound except for the portions of the components 17 which contact the heatsink 14. Thus, the regulating circuit is completely protected from physical interference and also from contact with any moisture which comes into contact with the heatsink unit. The potting compound also makes a sealing contact with electrical leads projecting through it to the regulating circuit, thus ensuring that moisture does not leak to the regulating circuit in this way. Preferably, the heatsink unit is made completely waterproof, or at least splashproof, in this way.

An upper surface of the potting compound 21 is covered by a plate 22. Thus the heat sink 14, and the plate 22 constitute a housing 25 for the regulating circuit.

A second plate 23 closes the cavity at the other side of the heat sink. The two plates 22, 23 are secured together by a pin 24 with cap 25, 26. The cavity formed between the plate 23 and the central region 15 of the heat sink 14 is filled with a potting compound 27.

The potting compound 21, 27 used in this embodiment is preferably thermally conductive, for example it may be a compound such as ER2/83 supplied by Electrolube.

Figure 9:
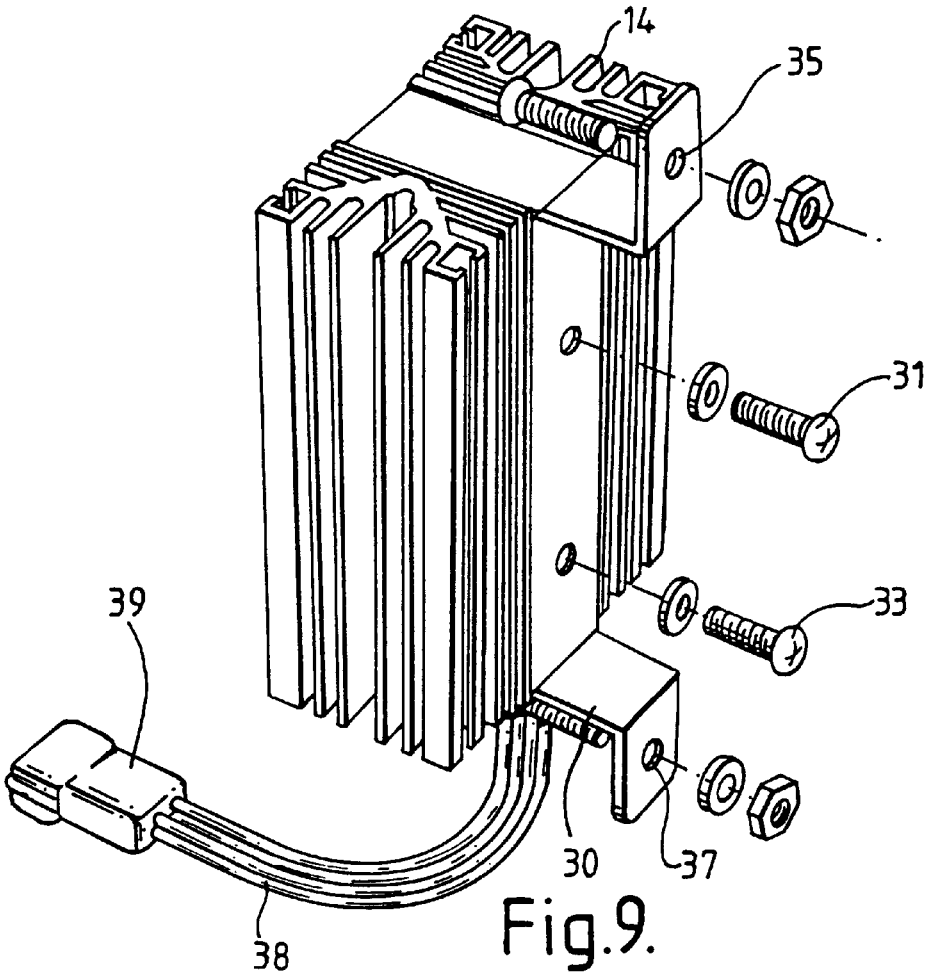
FIG. 9 shows a perspective view of the heat sink of FIG. 7.

FIG. 9 is a perspective view of the unit shown in FIG. 8. A bracket 30 is attached to the heat sink unit by screws 31, 33, and is adapted for connection using apertures 35, 37 to the body of a piece of machinery such as under the dashboard of or to the chassis of a lorry. Electrical inputs to the heat sink unit are via leads 38 and plug 39.

Figure 10:
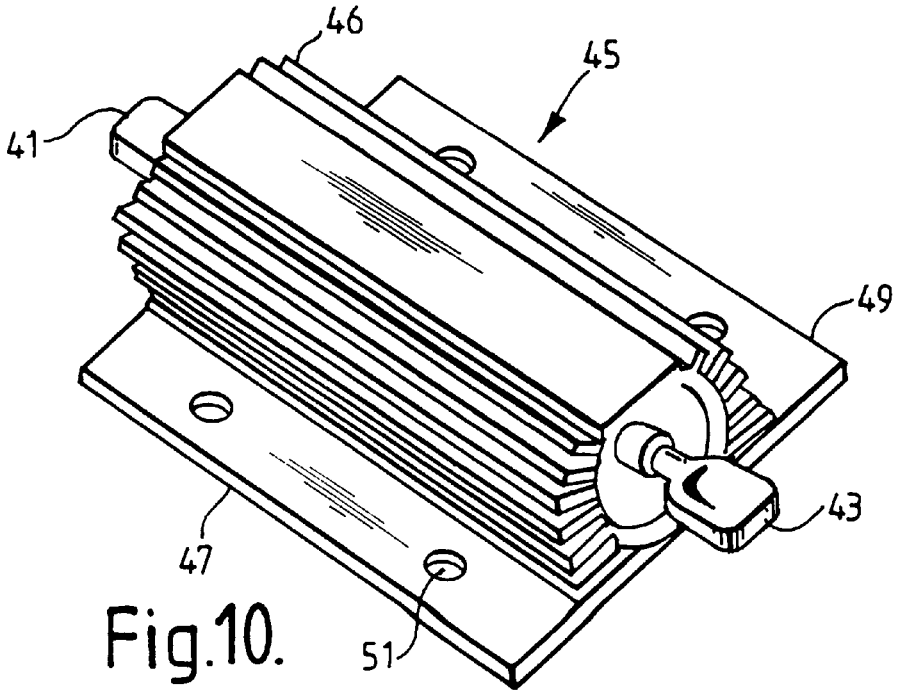
FIG. 10 shows a perspective view of a resistance unit for use in a converter according to the present invention.

FIG. 10 illustrates in perspective view a resistor unit 45 containing the resistor (R1,R1') of an embodiment of a converter according to the invention. The resistor has pins 41, 43 by which it may be electrically connected to the rest of the converter. The resistor unit 45 includes its resistor surrounded by, and electrically insulated from, cylindrical portion 46 of a housing including plates 47, 49. The housing is an aluminium extrusion. The plates 47, 49 are provided with apertures 51, for attaching the housing, for example, to the chassis of a lorry, so that excellent thermal conduction between the resistor and the chassis is obtained. The cylindrical portion 46 is externally ribbed, to assist heat dissipation by convention, but typically in use between 50 and 100 watts are thermally conducted to the chassis.

Figure 11:
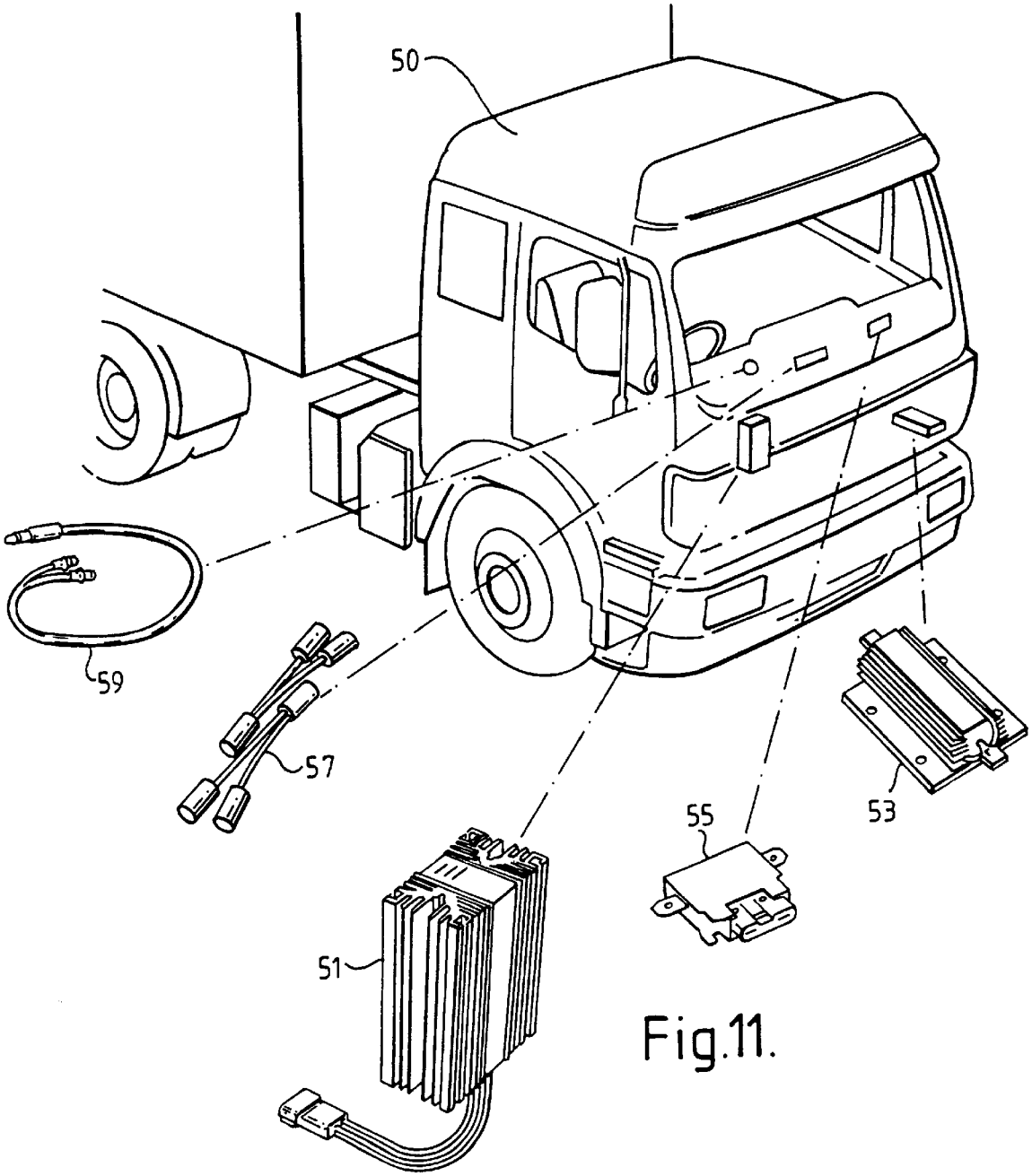
FIG. 11 illustrates the installation of a DC converter according to the invention.

FIG. 11 illustrates the installation of a converter according to the invention into the cab 50 of a lorry. The heat sink unit 51 is placed, with its longitudinal axis vertical inside the bonnet bulkhead. The ballast resistor 53 is located in the chassis area. The converter further comprises a fuse holder 55 inside the cab bulkhead, a multi connector kit 57, also within the cab bulkhead, and a LED 59 kit mounted on the dashboard.

Many modifications to the above embodiments are possible within the scope of the invention, as will be clear to those skilled in the art. For example, although preferable it is not necessary that the regulating circuit is of the linear conversion form, and alternative embodiments employing an oscillation-based regulating circuit are acceptable. The converter may also be used in combination with vehicles other than lorries, such as marine vessels for example, or even with less transportable items of machinery containing a DC power source.

I claim:

1. A vehicle having a vehicle body, a DC electric power supply of the vehicle mounted in the vehicle body, and a DC power converter, said converter converting a DC input voltage supplied by said DC power supply to generate a DC output voltage which is lower than said DC input voltage, and said converter comprising:

at least two input terminals electrically connected across said DC power supply;

an input resistance electrically connected to one of said input terminals; and a DC regulating circuit, electrically connected to said input resistance and to a further one of said input terminals, with said DC regulating circuit and said input resistance in series between said input terminals;

the input resistance and the DC regulating circuit being housed in first and second separate heat dissipative housings, said first housing dissipating heat generated by the input resistance and the second housing dissipating heat generated by said DC regulating circuit;

said first housing being mounted at a first location on said vehicle, and said second housing being mounted at a second location on said vehicle, said second location being different and spatially separated from said first location, whereby heat generated by said input resistance and dissipated by the first housing does not impair the operation of said DC regulating circuit; and the DC regulating circuit having at least one output electrical connector device for connection to a load external to the first housing and the second housing such that said DC regulating circuit can transmit at least several watts of power to said load through said electrical connector device in the form of said DC output voltage.

2. A vehicle according to claim 1 wherein at least one of the housings has an external surface in good thermal contact with said vehicle body and dissipates heat at least partly by conduction through said external surface of the housing.

3. A vehicle according to claim 1 in which at least one of the housings comprises a plurality of fins having a heat transmitting surface for transmitting heat to ambient air.

4. A vehicle according to claim 1 in which said fins have longitudinal symmetry.

5. A vehicle according to claim 1 in which the DC regulating circuit employs linear converters.

6. A vehicle according to claim 1 in which the regulating circuit operates such that a major proportion of the heat generated by the converter is generated by the input resistance means.

7. A vehicle according to claim 1 in which the regulating circuit limits the current which is drawn from the converter.

8. A vehicle according to claim 1 in which at least the housing of the input resistance means is mounted on the vehicle body with good heat conduction therebetween.

9. A vehicle according to claim 1 in which at least one of the first and second housings is provided with a high surface area for enhancing the transmission of heat to ambient air.

10. A vehicle according to claim 1 in which the regulating circuit contains no oscillator circuitry and operates without generating any substantial radio frequency electromagnetic radiation.

11. A vehicle according to claim 1 in which the regulating circuit ceases to supply an output voltage when at least a portion of the regulating circuit is at a temperature above a predetermined value.

12. A vehicle according to claim 1 wherein the input resistance has a resistance value in the range of about 0.1 to about 10 ohms.

13. A vehicle according to claim 1 in which said DC input voltage is about a nominal 24V, and said DC output voltage is about 12V.

14. A truck having a truck body, a DC electric power supply of the truck mounted in the truck body, and a DC power converter, said converter converting a DC input voltage supplied by said DC power supply to generate a DC output voltage which is lower than said DC input voltage, and said converter comprising:

at least two input terminals electrically connected across said DC power supply;

an input resistance electrically connected to one of said input terminals; and a DC regulating circuit, electrically connected to said input resistance and to a further one of said input terminals, with said DC regulating circuit and said input resistance in series between said input terminals, the input resistance and the DC regulating circuit being housed in first and second separate heat dissipative housings, said first housing dissipating heat generated by the input resistance and the second housing dissipating heat generated by said DC regulating circuit;

said first housing being mounted at a first location on said truck, and said second housing being mounted at a second location on said truck, said second location being different and spatially separated from said first location, whereby heat generated by said input resistance and dissipated by the first housing does not impair the operation of said DC regulating circuit; and the DC regulating circuit having at least one output electrical connector device for connection to a load external to the first housing and the second housing such that said DC regulating circuit can transmit at least several watts of power to said load through said electrical connector device in the form of said DC output voltage.

15. A truck according to claim 14 in which said DC power supply is the battery of the truck, and said battery is electrically connected to the motor of the truck.

16. In a vehicle having a vehicle body and a DC electric power supply of the vehicle mounted in the vehicle body, the improvement comprising a DC power converter, said converter converting a DC input voltage supplied by said DC power supply to generate a DC output voltage which is lower than said DC input voltage, and said converter comprising:

at least two input terminals to be electrically connected across said DC power supply;

an input resistance electrically connected to one of said input terminals; and a DC regulating circuit, electrically connected to said input resistance and to a further one of said input terminals, with said DC regulating circuit and said input resistance in series between said input terminals, the input resistance and the DC regulating circuit being housed in first and second separate heat dissipative housings, said first housing dissipating heat generated by the input resistance and the second housing dissipating heat generated by said DC regulating circuit;

said first housing being for mounting at a first location on said vehicle, and said second housing being for mounting at a second location on said vehicle, said second location being different and spatially separated from said first location, whereby heat generated by said input resistance and dissipated by the first housing does not impair the operation of said DC regulating circuit; and the DC regulating circuit having at least one output electrical connector device for connection to a load external to the first housing and the second housing such that said DC regulating circuit can transmit at least several watts of power to said load through said electrical connector device in the form of said DC output voltage.

17. A motor vehicle having a motor vehicle body, a DC electric power supply of the motor vehicle mounted in the motor vehicle body, and a DC power converter, said converter converting a DC input voltage supplied by said DC power supply to generate a DC output voltage which is lower than said DC input voltage, and said converter comprising:

at least two input terminals electrically connected across said DC power supply;

an input resistance electrically connected to one of said input terminals; and a DC regulating circuit, electrically connected to said input resistance and to a further one of said input terminals, with said DC regulating circuit and said input resistance in series between said input terminals, the input resistance and the DC regulating circuit being housed in first and second separate heat dissipative housings, said first housing dissipating heat generated by the input resistance and the second housing dissipating heat generated by said DC regulating circuit;

said first housing being mounted at a first location on said motor vehicle, and said second housing being mounted at a second location on said motor vehicle, said second location being different and spatially separated from said first location, whereby heat generated by said input resistance and dissipated by the first housing does not impair the operation of said DC regulating circuit; and the DC regulating circuit having at least one output electrical connector device for connection to a load external to the first housing and the second housing such that said DC regulating circuit can transmit at least several watts of power to said load through said electrical connector device in the form of said DC output voltage.

18. A motor vehicle according to claim 17 in which said DC power supply is the battery of the motor vehicle, and said battery is electrically connected to the motor of the motor vehicle.

19. A motor boat having a motor boat body, a DC electric power supply of the motor boat mounted in the motor boat body, and a DC power converter, said converter converting a DC input voltage supplied by said DC power supply to generate a DC output voltage which is lower than said DC input voltage, and said converter comprising:

at least two input terminals electrically connected across said DC power supply;

an input resistance electrically connected to one of said input terminals; and a DC regulating circuit, electrically connected to said input resistance and to a further one of said input terminals, with said DC regulating circuit and said input resistance in series between said input terminals, the input resistance and the DC regulating circuit being housed in first and second separate heat dissipative housings, said first housing dissipating heat generated by the input resistance and the second housing dissipating heat generated by said DC regulating circuit;

said first housing being mounted at a first location on said motor boat, and said second housing being mounted at a second location on said motor boat, said second location being different and spatially separated from said first location, whereby heat generated by said input resistance and dissipated by the first housing does not impair the operation of said DC regulating circuit; and the DC regulating circuit having at least one output electrical connector device for connection to a load external to the first housing and the second housing such that said DC regulating circuit can transmit at least several watts of power to said load through said electrical connector device in the form of said DC output voltage.

20. A motor boat according to claim 19 in which said DC power supply is the battery of the motor boat, and said battery is electrically connected to the motor of the motor boat.

* * * * *